US006929264B2

(12) United States Patent
Huard et al.

(10) Patent No.: US 6,929,264 B2
(45) Date of Patent: Aug. 16, 2005

(54) METHOD AND APPARATUS FOR MULTI PLAYER BET AUXILIARY GAME

(75) Inventors: Marcel Huard, St-Romuald (CA); Réal Bérubé , St-Jean-Chrysostome (CA); Martin Benoît Gagnon, Lévis (CA)

(73) Assignee: DEQ Systemes Corp., St-Romauld (CA)

( * ) Notice: Subject to any disclaimer, the term of this patent is extended or adjusted under 35 U.S.C. 154(b) by 24 days.

(21) Appl. No.: 10/163,623

(22) Filed: Jun. 7, 2002

(65) Prior Publication Data

US 2003/0137110 A1 Jul. 24, 2003

Related U.S. Application Data

(60) Provisional application No. 60/363,282, filed on Mar. 12, 2002, and provisional application No. 60/349,558, filed on Jan. 22, 2002.

(51) Int. Cl.[7] ..... A63F 1/00
(52) U.S. Cl. ..... 273/274; 273/292
(58) Field of Search ..... 273/274, 292; 463/11–13

(56) References Cited

U.S. PATENT DOCUMENTS

| | | | | |
|---|---|---|---|---|
| 4,861,041 A | | 8/1989 | Jones et al. | |
| 5,042,810 A | | 8/1991 | Williams | |
| 5,393,067 A | | 2/1995 | Paulsen et al. | |
| 5,570,885 A | | 11/1996 | Ornstein | |
| 5,586,766 A | | 12/1996 | Forte et al. | |
| 5,823,875 A | | 10/1998 | Tarantino | |
| 5,829,750 A | | 11/1998 | Booker | |
| 5,868,392 A | * | 2/1999 | Kraft | 273/292 |
| 5,871,213 A | * | 2/1999 | Chadband et al. | 273/292 |
| 6,070,878 A | | 6/2000 | Jones et al. | |
| 6,113,102 A | | 9/2000 | Marks et al. | |
| 6,146,270 A | | 11/2000 | Huard et al. | |
| 6,237,916 B1 | | 5/2001 | Webb | |
| 6,328,306 B1 | * | 12/2001 | Webb | 273/274 |
| 6,471,210 B1 | * | 10/2002 | Goldman et al. | 273/292 |
| 2001/0024015 A1 | | 9/2001 | Hogan et al. | |

FOREIGN PATENT DOCUMENTS

| | | |
|---|---|---|
| WO | WO 99/10057 | 3/1999 |

* cited by examiner

*Primary Examiner*—Vishu K. Mendiratta
(74) *Attorney, Agent, or Firm*—Isabelle Chabot; Ogilvy Renault, LLP

(57) ABSTRACT

A method and system for playing an auxiliary casino game managed by a casino house comprising: selecting at least one player of an underlying casino game on which to place a bet; identifying at least one event related to at least one play of the underlying game for which to place the bet; making a bet that at least one event will occur in association with a player during at least one play of the underlying game; determining an occurrence of the event in the underlying game in association with the player; if the event occurred in association with the at least one player, determining a payout to be paid.

21 Claims, 9 Drawing Sheets

METHOD AND APPARATUS FOR MULTI PLAYER BET AUXILIARY GAME

CROSS-REFERENCE TO RELATED APPLICATIONS

This application claims priority of a provisional patent application filed Jan. 22, 2002 and bearing Ser. No. 60/349,558 and of a provisional patent application filed Mar. 12, 2002 and bearing Ser. No. 60/363,282.

FIELD OF THE INVENTION

The present invention relates to a method and system for playing a multi player bet game. More particularly, the invention relates to a method and system for playing a multi player bet game allowing a player to make a bet that at least one player, including the dealer, playing an underlying casino game, will receive a determined events during a play or a plurality of plays of the underlying casino game.

BACKGROUND OF THE INVENTION

Casino owners are always interested in enhancing the profitability of their casino games. More particularly, new and improved casino games allowing for faster-paced games, an increase in the betting amount per game, and a raise in the player's interest in the game, present a real appeal to casino house managers.

In recent years, additional betting opportunities, other than the standard bet or wager, have been introduced in casino games. Typically, such additional betting options give players further opportunities to win prizes, tend to enhance the assiduity of players to an underlying game, and enlarge the total amount wagered on a play of the underlying game. Consequently, the casino game profitability could be enhanced.

More specifically, some card games now offer players the possibility of betting on the occurrence that they will receive a predetermined hand during a play of the underlying game. These types of games require that the player who wants to wager, participate in a play of an underlying game or at least receive one gaming symbol during a play of the underlying game.

In other card games, the bet made by the player is a bet on a predetermined card hand received not by the player who made the bet but by the dealer, during the play of the underlying game. Consequently, for such games, a player who wants to wager on the occurrence of a combination of gaming symbols within a specified hand associated with the dealer, may make a wager without participating in a play of an underlying game.

Allowing these types of bets on gaming symbols received by the dealer during a play of an underlying game, without requiring a receipt of gaming symbols by the player during the play of the underlying game, is particularly advantageous for players who feel unlucky or inexperienced at the underlying game.

Finally, other card games offer players the option of placing a bet on the occurrence of a predetermined hand associated with either the player making the bet or the dealer, during the play of the underlying game.

Despite the fact that the above mentioned types of games present a real appeal to the player and contribute to an increase in casino game profitability, such methods, enabling a player to bet on a combination of game symbol eventually received by a dealer present some disadvantages as well.

Offering the possibility of placing a side bet on the occurrence of a combination of gaming symbols within a specific hand associated with the dealer, increases the complexity of the dealer task, enhances the probability of mistakes and slows down the pace of the game. In fact, in addition to playing, determining winners and calculating payout for the underlying game, the dealer has to determine who has made such a side bet and resolve wins and losses. Typically, a plurality of side bet options are offered, in which case, the task of de dealer is more complex, longer and more prone to mistakes or cheating. Consequently, the pace of both the underlying game and the side bet game is decreased.

Furthermore, in general, when a side bet option is offered, at least one additional side bet region on the playing surface is provided at each player position. Typically, a plurality of side bet betting options on a plurality of possible dealer events are offered. Then a plurality of side betting areas is provided at each player station. Consequently, some tokens can be moved—inadvertently or intentionally—during a play of an underlying game. This high density of betting chips and of adjacent betting areas can bring confusion and dispute among players and dealer. These facts favor mistakes, disputes and cheating and contribute to slow the pace of plays of the underlying game, and may be more annoying than entertaining for players including the dealer.

SUMMARY OF THE INVENTION

Extending the spectrum of gaming symbols that can be matched in a side bet game provides variety, a larger spectrum of odds and thus, a larger flexibility of prize amount that can be awarded. Consequently, the casino has the opportunity to modulate its income and the players gain access to a plurality of prizes of low and high value, with high or low odds of occurrence.

In addition to the house predetermined events, permitting that the gaming symbols to be matched be randomly selected or predetermined by the player, represents an advantage. In fact, a partial or complete random events to be matched can avoid feelings of collusion between the dealer and the players. Also, allowing a player to select a part or the totality of gaming symbols to be matched, presents an appeal to players, giving them a feeling of control over the issue of the symbol match for which they have made a bet.

Furthermore, offering players the possibility to bet alternatively on their combination of gaming symbols, the dealer's or another player's represents a advantage. In fact in certain circumstances, some players have the feeling that during the course of a play, some players seem luckier than others and particularly, in obtaining certain events.

For example, during the course of a blackjack game, a player might feel that the dealer or another player is a lucky player, while he feels unlucky. The player decides to stop his participation in the underlying game but decides to continue wagering on occurrences of predetermined events in specific hands, associated to the dealer or to another player during the course of the underlying game. For example, the player might bet that the dealer and/or another player will receive at least an Ace of any suit or that the dealer and/or the other player will receive a card hand of a total amount of a certain suit or also, that the dealer or the player will receive a standard blackjack hand or a certain card hand value such as 16, 17, 18, 19, 20 or 21, of the same suit.

Offering players the possibility to bet on a event received by another player in conjunction with or independently of participating in the underlying game, constitutes an advantage. Indeed, certain players, feeling unlucky or inexperienced at the game may prefer to bet only on a particular event to be received by at least one player during the course of the play of the underlying game. This way, they can participate and have the chance to win, and at the same time, become more knowledgeable of the game rules and strategies. Players who feel lucky can participate in the underlying game, and furthermore can take advantage of lucky or unlucky periods of other players, including the dealer, by making bets that these players will obtain certain event. For example, a player who feels lucky may want to maximize his earnings during this lucky period, he will then bet on his own hand but might also enjoy betting on the other players' hands, Typically, side bet acceptors have been designed to accept and manage bets made by a player on the occurrence of a predetermined card hand associated to the player who made the bet, during the course of the underlying game. Typically, the side bet acceptors indicate and register the wager amount, signaling to the dealer which player has decided to make a side bet. Nevertheless, the dealer has to resolve wins and losses and determine the payout for each player.

A bet controlling and managing system has to be developed for games that allows betting on the occurrence of a predetermined game symbol combination, within a specific hand associated with a player, other than the player who makes the bet.

A bet controlling and managing system would be a valuable addition to existing games that allow players to bet on card hands received by the dealer, in that it would increase the efficiency of the dealer, by determining wins and losses for a plurality of betting combinations and their respective payouts.

A bet controlling and managing system would be a valuable addition to existing games that allow players to bet on card hands received by the dealer, by increasing the pace of the game and the reliability of bet transactions during the course of the existing games. Until now, no particular apparatus or system has been designed that controls and manages bets associated with a predetermined card hand received by the dealer.

Furthermore, the bet controlling and managing system allows the integration of the functional features of the present invention, while, at the same time, enhancing the pace of play of the underlying game and improving reliability of the betting transactions. Such a bet controlling and managing system will be a source of profitability for all games allowing bets on at least one gaming symbol received by any player during the course of play of an underlying game, including existing blackjack games allowing bets on predetermined hands dealt to a dealer during the play of the underlying game.

Finally, a bet controlling and managing system such as the one of the present invention constitutes an asset in increasing the profitability of casinos, by allowing for a wider array of side bet possibilities and a larger amount of bets per play, by providing a safer and faster bet management and control system and by enhancing the pace of the games.

Accordingly, an object of the present invention is to provide a method for wagering on the occurrence of receipt of gaming symbols during a play of an underlying game by at least one player, the method being flexible and applicable to a plurality of casino games.

It is another object of the invention to provide a method for wagering on the occurrence of receipt of gaming symbols during a play of an underlying game by a player, which player is a different player from the player who makes the wager.

It is another object of the present invention to provide a method for wagering on the occurrence of receipt of card symbol combination during a play of an underlying card game by at least a player participating to the underlying game. The player who received the event is a different player from the player who makes the wager. The player who received the card symbols may be a client-player or an employee-player (i.e. dealer).

It is another object of the invention to provide a method for wagering on the occurrence of receipt of card gaming symbols by a dealer.

Furthermore, it is an object of the invention to provide a system that permits a player to make a wager on the occurrence of receipt of at least one gaming symbol or at least a events during a play of an underlying game by at least one player participating in the underlying game.

Furthermore, it is another object of the invention to provide a system permitting a player, participating or not in the underlying game, to make a wager on the occurrence of receipt of at least one gaming symbol by at least one player participating in the underlying game.

Furthermore, it is another object of the invention to provide a system permitting a player, participating or not in the underlying game, to make a wager on the occurrence of receipt of at least one gaming symbol by at least one player participating in the underlying game, the at least one player receiving the gaming symbols being a different player from the player who makes the wager.

The method and system of the present invention can be applied to a plurality of standard or new casino games.

According to a first broad aspect of the present invention, there is provided a method for playing an auxiliary casino game managed by a casino house comprising: selecting at least one player of an underlying casino game on which to place a bet; identifying at least one event related to at least one play of the underlying game for which to place the bet; making a bet that the at least one event will occur in association with the at least one player during at least one play of the underlying game; determining an occurrence of the at least one event in the underlying game in association with the at least one player; if the at least one event occurred in association with the at least one player, determining a payout to be paid.

According to a second broad aspect of the present invention, an apparatus for playing an auxiliary casino game, the system comprising: a player selection receiver for receiving a player selection from at least one player of an auxiliary casino game, the player selection identifying at least one player of the underlying casino game on which to place a bet; an event receiver for receiving from the at least one player of the auxiliary casino game, an identification of at least one event related to at least one play of the underlying game for which to place the bet; a bet receiver for receiving a bet from the at least one player of the auxiliary casino game that the at least one event will occur in association with the at least one player of the underlying game during at least one play of the underlying game; auxiliary bet display means for displaying an identification of the at least one selected player of the underlying game and of the at least one identified event related to the player of the underlying game; an outcome receiver for receiving an outcome indication indicating if the at least one identified event in the underlying game occurred in association with the at least one selected player of the underlying game during the at least one play of the underlying game; a winning player determiner for determining which of the players placed a bet on the outcome which occurred.

For the purpose of the present invention, the term "event" is intended to mean any event which occurs during the course of a casino game. It can be associated to a player or not. It can constitute a preliminary, intermediary or end result of the game. It can comprise a selection or combination of gaming symbols. The mere occurrence of a gaming symbol during a play of a game can be considered to be an event. An event can also be the selection of a player in a game. For example, an event can be a player's hand of cards at the end of a play of a card game. Another example of an event could be the gaming symbols which make the outcome of a roulette play. Still another example of an event could be the first card dealt to the dealer after mixing the cards in a card game. Another example would be the selection of a particular player at a casino game.

For the purpose of the present invention, the term "gaming symbol" is intended to mean any symbol used in any casino game. It can be a number, a colors a figure, a suit, etc. It can also be a specific card in a card game. Selections and combinations of gaming symbols can be made to represent all possible events which can occur in a casino game.

BRIEF DESCRIPTION OF THE DRAWINGS

These and other features, aspects and advantages of the present invention will become better understood with regard to the following description and accompanying drawings wherein.

DETAILED DESCRIPTION OF THE PREFERRED EMBODIMENT

Figure 1:
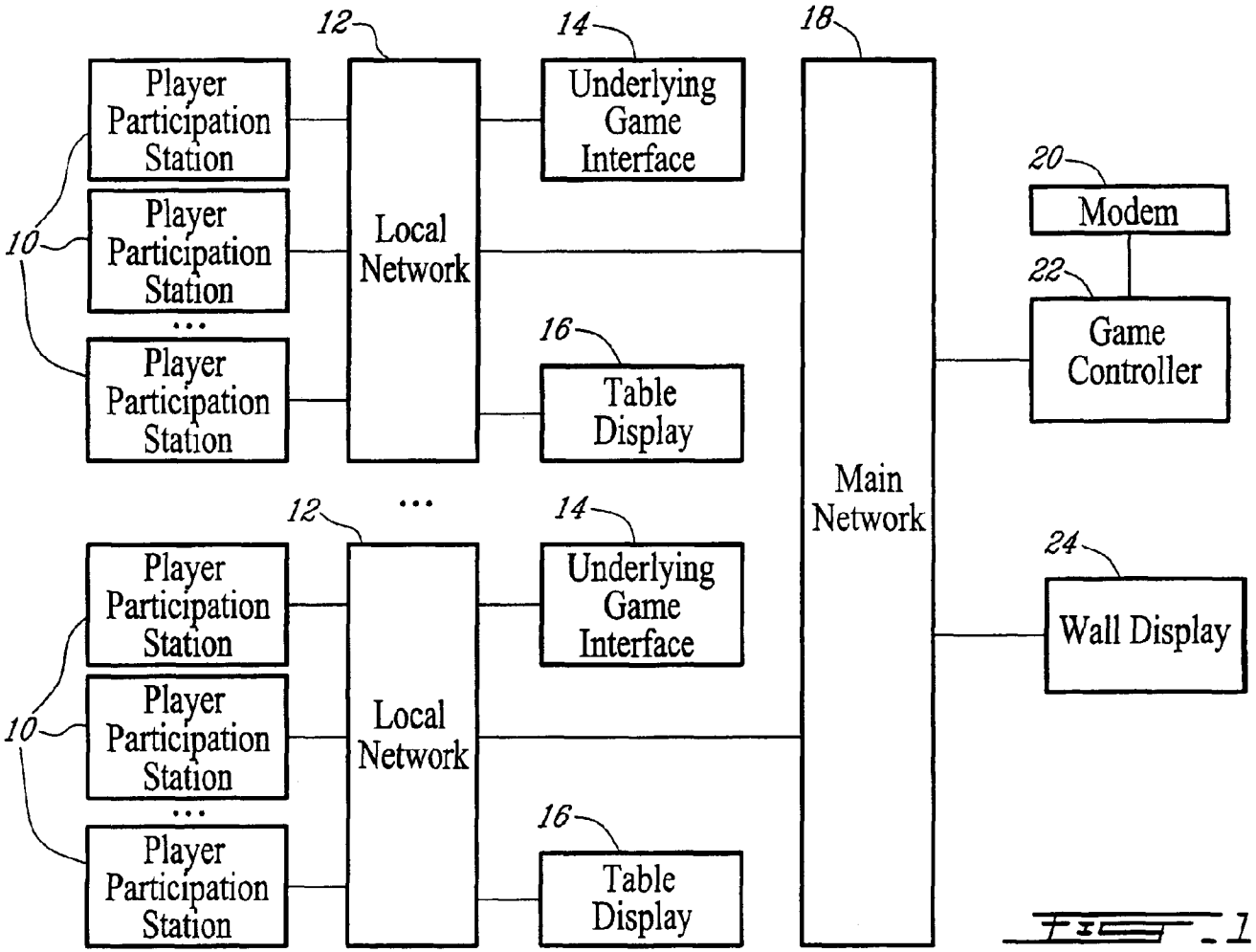
FIG. 1 is a schematic representation of the system according to a preferred embodiment of the present invention.

While illustrated in the block diagrams as groups of discrete components communicating with each other via distinct data signal connections, it will be understood by those skilled in the art that the preferred embodiments are provided by a combination of hardware and software components, with some components being implemented by a given function or operation of a hardware or software system, and many of the data paths illustrated being implemented by data communication within a computer application or operating system. The structure illustrated is thus provided for efficiency of teaching the present preferred embodiment.

The system of the present invention will now be described with reference to FIG. 1 and FIG. 2. The system comprises a plurality of player participation stations 10, an underlying game interface 14, a table display 16, a game controller 22 and a wall display 24. Local network 12 and main network 18 ensure communication between the plurality of units of the system. Of course, the network communication could be wired or wireless. In the present embodiment, a RS 485 network is used.

The game controller 22 is in communication with one or a plurality of local networks 12 Each local network 12 communicates with a number of player participation stations 10, with at least one underlying game interface 14, and at least one table display 16. Each local network 12 is associated to an underlying game. The game controller 22 controls and manages bet selection data, outcome data, credit data, prize data and information between the different units of the system.

Preferably, the game controller 22 is in communication with three random selectors: a random gaming symbol selector 26, a random player selector 28 and a random prize selector 30. A modem 20 is connected to the game controller 22 permitting to operate the game controller 22 from a remote location or to communicate with other game controllers located in the same casino or in other casinos.

The random symbol selector 26 includes a random number generator for picking a gaming symbol from a virtual set of gaming symbols related to the underlying game 58. The random symbol selector 26 generates a value representing a set of gaming symbols related to the underlying casino game 56. Of course, other types of random gaming symbol selectors, such as: manual, mechanical and electrical random gaming symbol selectors can be used.

The random player selector 28 includes a random value generator for randomly generating a value representing a player or a group of players, located at a player position around the table game. Of course, other types of random player selectors, such as: manual, mechanical and electrical random player selectors can be used.

The random prize selector 30 includes a computer random generator for randomly generating a value representing a prize. The prize could be tangible, such as a car, a trip, etc. or be a cash amount. Again, other types of random prize selectors can be used.

Figure 2:
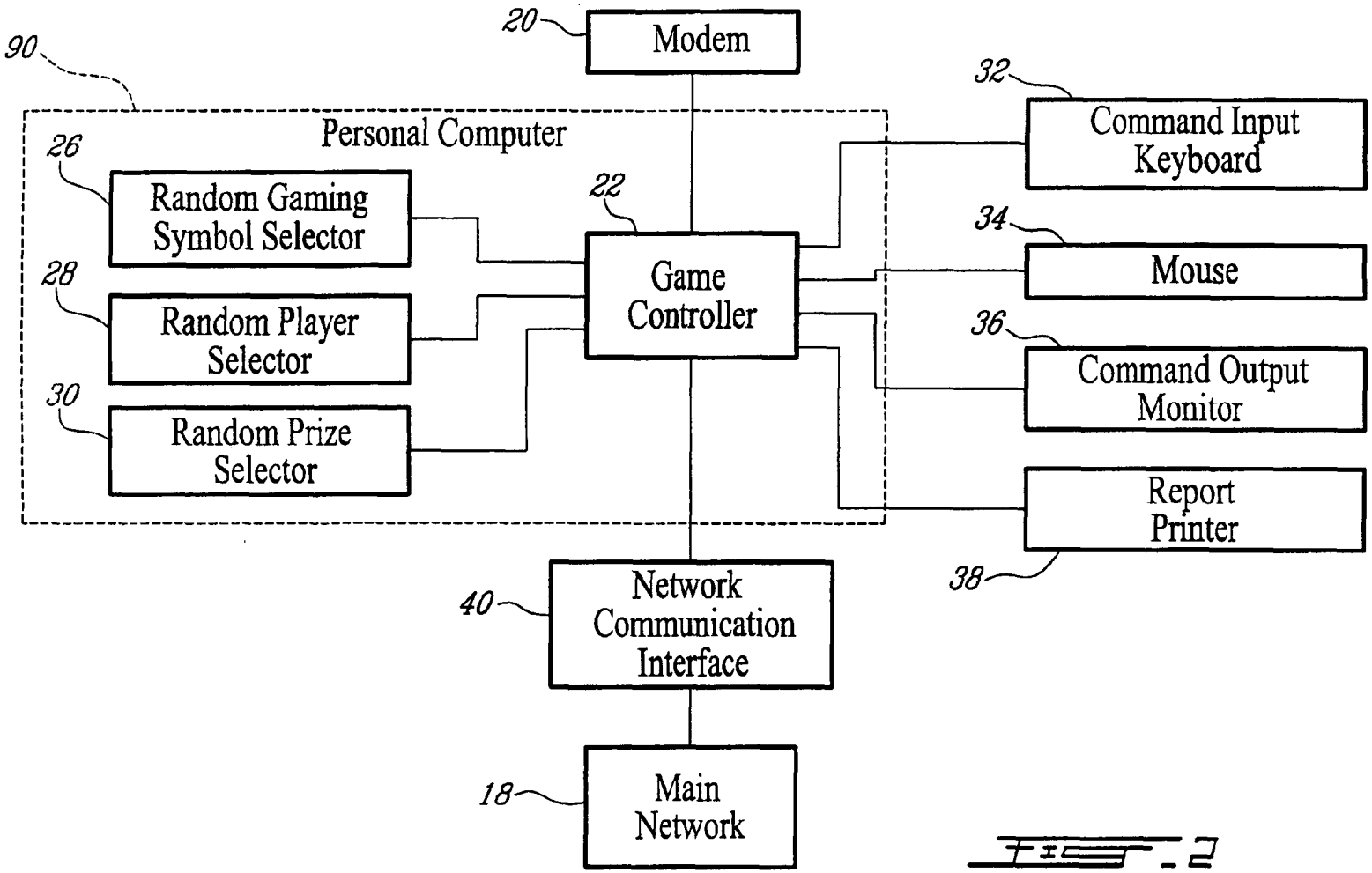
FIG. 2 is a schematic representation of the game controller according to a preferred embodiment of the present invention.

As it can be appreciated and as shown in FIG. 2, game controller 22, random player selector 28 and random prize selector 30 could be integrated into a personal computer (PC) 90 provided with a communication interface 40 for communicating with the plurality of units in communication with the game controller 22. In the preferred embodiment, a RS 485 Network interface is used.

The personal computer 90 contains programs necessary to run the system of the present invention. Furthermore, a command input keyboard 32, a mouse 34, a command output monitor 36 and a report printer 38 can be connected to the personal computer 90.

Figure 3:
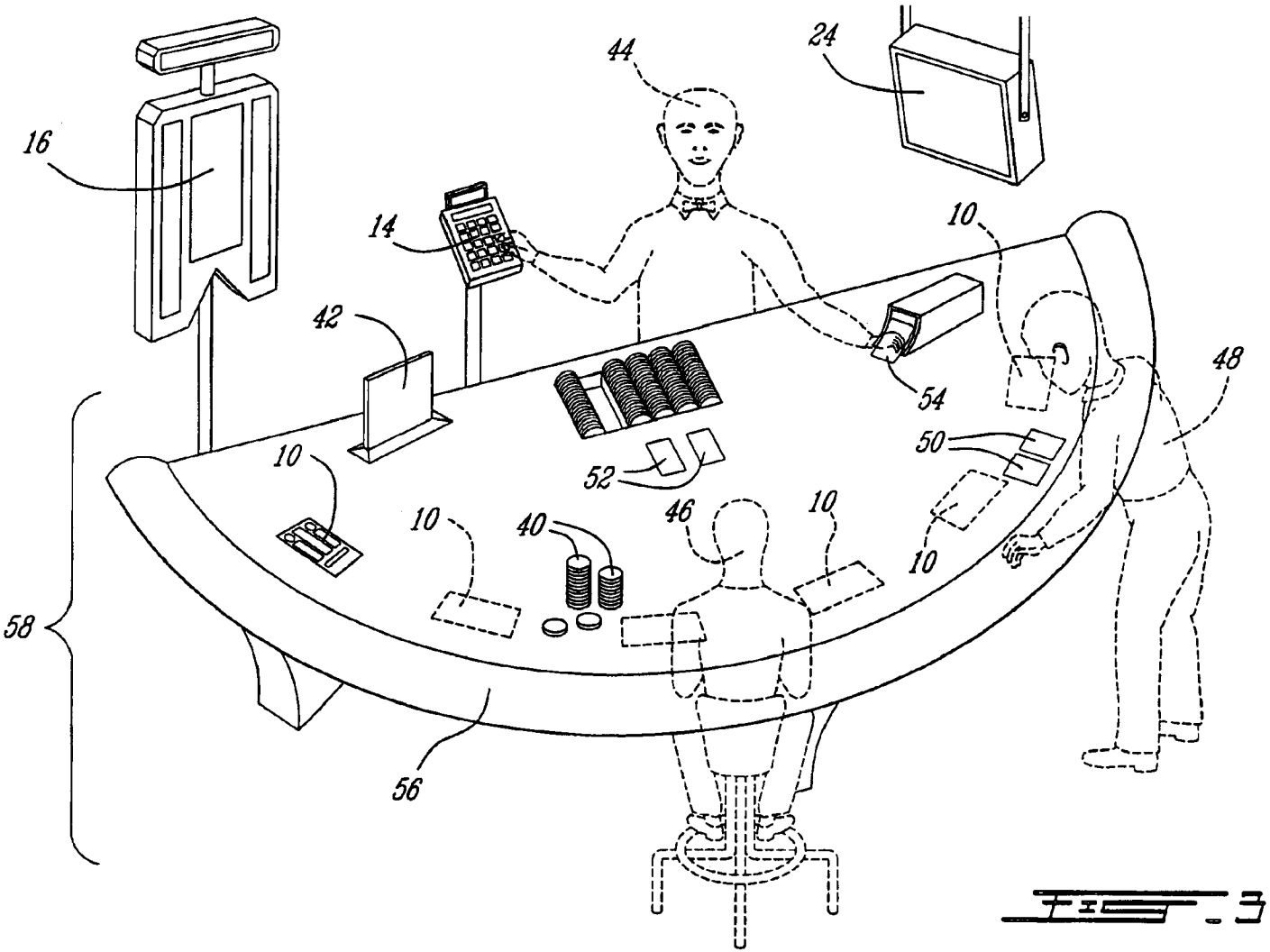
FIG. 3 is a schematic view and representation of the system according to a preferred embodiment of the present invention.

Referring now to FIG. 1 and FIG. 3, the player participation station 10 allows a player to participate in an auxiliary game, played in conjunction with an underlying casino game. More specifically, the player participation station 10 allows a player to wager on a number of events which will be associated with or received by one or a plurality of participating players, during a play of an underlying game. The player participation stations 10 can be installed around a casino table 56 as shown in FIG. 3. Nevertheless, it will be apparent that the player participation station 10 can be installed at a remote location from the table 56. Such a player station could be placed at another casino game table, at a bar or besides a slot machine, or again, in another casino or even, in a hotel room, in an office or inside a private home wherein the player participation stations 10 are in communication with the game controller 22 via a local wired or wireless network or/and via the internet. The game controller 22 is in communication with a modem 20. The modem 20 can be used as a communication means with another casino game controller, a hotel server, or with an internetwork server, permitting players to participate in an auxiliary game, played in conjunction with an underlying game, from their own intranet and/or internet player participation station terminals.

The system comprises an underlying game interface 14. The underlying game interface 14 is in communication with a number of player participation stations 10, associated with a same underlying game 58, and with a table display 16 via a local network 12. The underlying game interface 14 is in communication with the game controller 22 via the local network 12 and main network 18. The dealer 44 responsible for the underlying game 56 inputs, using an underlying game interface 14, the betting period signal and some outcomes of the play produced by the underlying game. Particularly, outcome data input by the dealer, concerning the underlying game, typically include a number of selections of gaming symbols related to the underlying game 56 and a number of indicators identifying a number of players 48 having received some of the selections of gaming symbols, during the play of the underlying game.

The table display 16 is preferably in communication with the underlying game interface 14 via a local network 12 and in communication with the game controller 22 via a main network 18.

A wall display 24 is in communication with the game controller 20 via a main network 18. The wall display 24 may display a plurality of information such as underlying game outcomes, random selection results, jackpot value and prizes, winning combinations and winners, some game information and/or advertising messages. Because of its preferred size and disposition, the wall display 24 can be viewed by a larger group of casino players and clients. Furthermore, the wall display 24 is appropriate to communicate data for a plurality of games played in conjunction with a plurality of underlying games.

It will be understood that a game controller 20 could be in communication with a plurality of underlying game interfaces 14 providing players with a plurality of games played in conjunction with a plurality of underlying games.

The present invention can be applied successfully to a plurality of casino games, particularly to casino card games. Players have the possibility of making a bet that at least one player playing the underlying game will receive a particular events during a play or a plurality of plays of the underlying casino game. Four categories of betting options can be distinguished, namely:

a) a unique, predetermined player will receive a unique predetermined event;
b) a unique, predetermined player will receive at least one of a number of determined events;
c) at least one of a number of players will receive a unique predetermined event;
d) at least one of a number of players will receive at least one of a number of events.

For each category, different modalities of selection of players and/or of events can take place. The selection of players can be randomly preformed or predetermined by a casino house, a player, or a dealer. Similarly, the event can be randomly performed or predetermined. Combinations are also possible. For example, a category could have a random player selection with a predetermined event; a random player selection with a random event; and a predetermined player selection with a random event.

Furthermore, for a same underlying game, a same category and modality can be maintained all the time or the category and/or modality can be changed from play to play of an underlying game.

Before playing a game, some parameters must be set in the game controller 22. The parameters concern essentially a selection of game(s), the rules of operation of the game(s), a selection of betting categories and modalities and payout determining and calculating processes.

Figure 4:
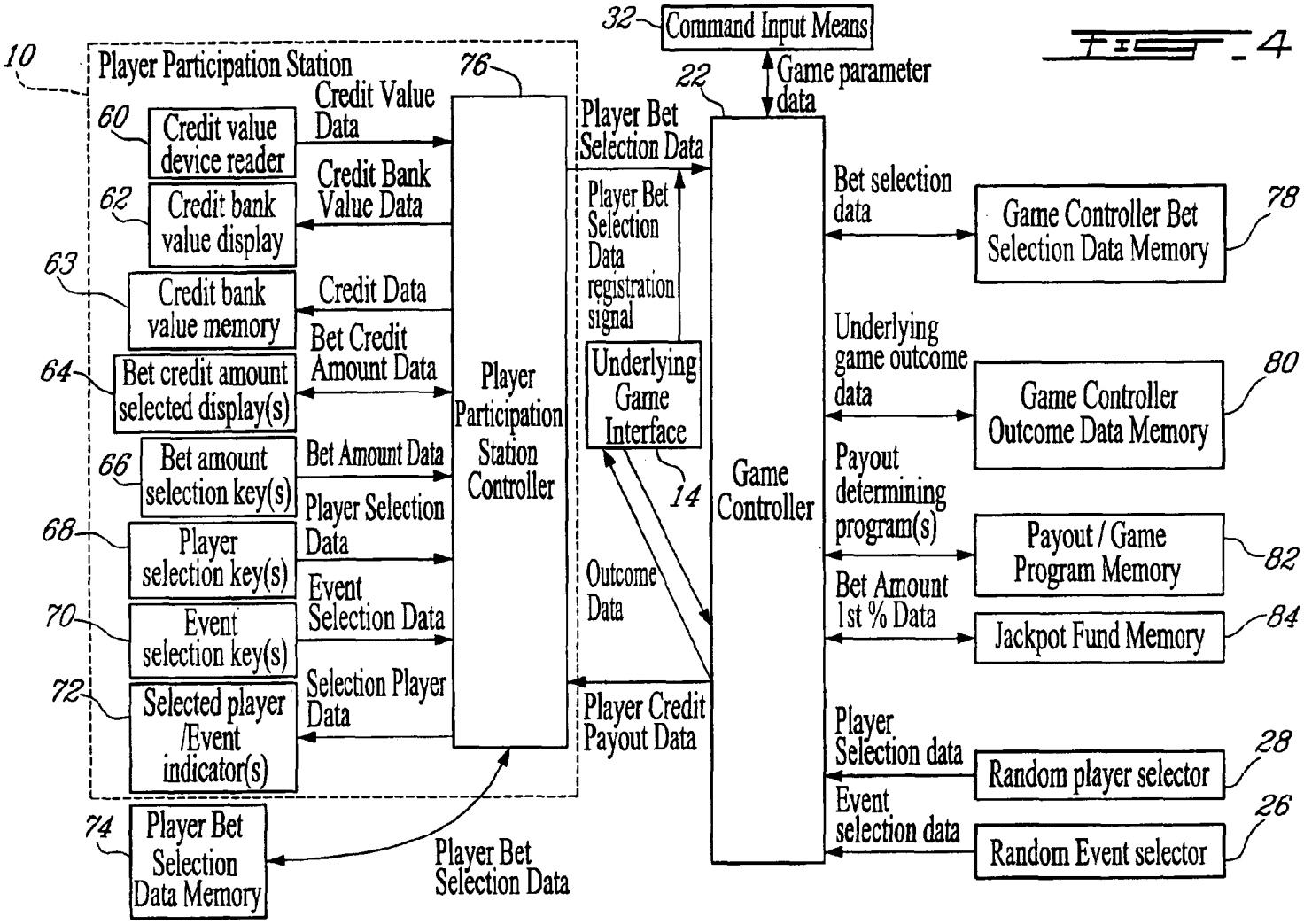
FIG. 4 is a block diagram of the system according to a preferred embodiment of the present invention.

As shown in FIG. 4, a command input means 32 allows to specify the game parameters. Upon reception of game parameter data, the game controller 22 selects a number of game programs from a game program memory 82. The game controller 22 selects a payout determining program from a game program memory 82. Consequently, the bet selection data memory 78 and the outcome data memory 80 are addressed as a function of the game program(s) selected and payout determining program(s) selected.

The data storage support device can be a portable data storage support device or a fixed data storage support device. In the present embodiment, the data support devices are fixed and are integrated into a personal computer 90.

It will be also understood that if just one type of game, category, modality and payout are retained or used, the step of game setting is no longer required.

The game controller 22 can be alternatively a stand-alone unit or an integrated unit with a player participation station 10 or with an underlying game interface 14.

Before or at the beginning of the game, a player inserts a credit value device into a credit value device reader 60 in communication with a player participation station controller 76. The credit value device could take on a plurality of embodiments. For example, a credit value device could be a monetary value device such as a bill and/or a credit value device such as a token, a magnetic card, a bar code ticket or a smart card. Consequently, the credit or monetary value device is read by an appropriate credit value device reader 60.

Once the monetary or credit value device is read, the credit value associated to the monetary or credit value device is stored into a credit bank memory 63 in communication with the player participation station controller 76. The credit value stored into the credit bank memory 63 is displayed on a bank credit value display 62 in communication with the player participation controller 76.

According to the category of the game, a number of player selection key(s) 68 and/or a number of event key(s) 70 are in communication with the player participation station controller 76. In fact, if the game consists of betting on a events received only by a same and unique player, predetermined or randomly selected, for a play of an underlying game and applicable for all players, the player selection key 68 could be omitted. In a similar manner, if the game consists of betting on a same and only one event, predetermined or randomly selected, received by or associated with at least one player, a gaming symbol selection key 70 could be omitted. In other cases, the player 46 selects his betting options; namely selection of at least one player 48 with a player selection key(s) 68 and namely at least one gaming symbol selection with a gaming symbol selection key(s) 70.

For each betting option selected, i.e. for each combination of at least one player and at least one event, a bet option is selected and the betting option consists of betting that the at least one player selected will be associated with the at least one gaming symbol selected during a play of an underlying game. Furthermore, once the betting selection is made, a bet credit amount is selected with a bet credit amount selection key(s) 66. The bet credit amount selected is displayed on a bet credit amount selection display 64. At the same time the selected bet credit value is subtracted from the credit bank value memory 63 and stored into a player bet selection data memory 74 in communication with the player participation station controller 76. The new credit bank value is displayed on the credit bank value display 62.

Once a bet selection is completed, the bet selection data are stored into a player bet selection data memory 74 in communication with the player participation station controller 76. Examples of player bet selection data are: bet credit amount data; event data; player selection data, and by default, player station identification data.

It will be understood, that credit bank memory 63 and the player selection data memory 74 could be a portable storage device such as a smart card, or a magnetic card. Furthermore, the credit bank memory 63 and/or player selection data memory 74 could be in direct communication with the game controller 22 instead of the player participation station controller 76.

When the player selection and/or event have been performed, player selection or/and event indicators 72 are activated and indicate player(s) and gaming symbol(s) of player bet selection.

Of course such indicators can take a plurality of embodiments. For example, the indicators can be lights associated to each player selection and/or event or can be display means for representing some symbols and letters.

In a similar manner, bet credit amounts selected are displayed on bet credit amount display 64.

Key(s) and/or key functions can be integrated or associated to a same and unique device Furthermore, the term "key" denotes a plurality of selection means permitting a player to make a selection. Such key(s) could take on a plurality of embodiments such as electro-mechanical buttons, digital keys, etc.

For example, if there is a plurality of player selection keys 68, each key being assigned to a particular player, then a bet credit amount selection function can be integrated with each player selection key 68. A player selection key 68, associated to a particular player, could be designed such that in activating the player selection key 68 for the first time, the activation causes the selection of the player as a betting data. At the same time, the minimal betting credit amount, that can be wagered, is associated automatically to a bet concerning the selected player. Furthermore, each successive activation input of the same player selection key 68 adds a minimal credit betting amount to the betting amount associated to the betting option concerning the selected player, identified by the activated player selection key 68.

As it will be understood by a person skilled in the field, some indicators or displays can be integrated or associated with a same displaying or indicating device.

At an underlying game table, the dealer 44 invites players to bet on the occurrence of the receipt of a combination of events by a selection of a number of players during a play of the underlying game 58. The players make their bets by selecting the appropriate events, players and credit bet amount with the help of appropriate keys.

At an appropriate time during the play of the underlying game 58, typically before events received or associated to players during a play of the underlying game are revealed and/or known by the players, the dealer 44 activates an appropriate key on an underlying game interface 14. The activated appropriate key on the underlying game interface 14 provides a player bet selection data registration signal to each player participation station 10 for a same underlying game. Once the player bet selection data registration signal is received by each player participation station controller 76, the player bet selection data—such as bet credit amount, event, player selection, and by default, player station identification—stored into a player bet selection data memory 74, are sent to the game controller 22. Furthermore, in the case where a plurality of plays of a plurality of underlying games can be played, a tag identifying the corresponding play of the underlying game is associated to player bet selection data sent to the game controller 22.

Upon reception of player bet selection data associated to a play of an underlying game by the game controller 22, the player bet selection data are stored into a game controller bet selection data memory 78 in communication with the game controller 22. Typically, bet selection data stored into a game controller bet selection data memory cell comprises data such as: bet amount, event, player selection, player station identification, and optionally, a code (i.e. a "tag") identifying a play of the underlying game.

During a play of an underlying game, some gaming symbols or events are received or associated to some players participating in the play of the underlying game. This is considered to be an event in the underlying game.

For example, during a play of an underlying card game, card hands are received by players 48. Once some cards received or associated to a player are revealed, the dealer 44 may input the underlying game outcomes i.e. data corresponding to the association of a number of event with a number of players during the play the underlying game using the underlying game interface 14. Once the underlying game outcomes are registered into the underlying game interface 14, the underlying game outcome data are sent to the game controller 22. Again, in the case in which a plurality of plays of a plurality of underlying games can be played in same time, a code, identifying the play and the underlying game to which the underlying game outcome data are associated, can be added to the underlying game outcome data sent to the game controller 22.

Depending on the rules of the principal an/or auxiliary game played in conjunction with the underlying game, and the underlying game outcomes, none, one or a plurality of events and none, one or a plurality of player identifications have to be registered by the underlying game interface 14.

In a preferred embodiment, the dealer 44 has to register a different number of player identifications and events depending of the category of the game.

When the bet stipulates that a unique predetermined player will receive a unique predetermined event, the dealer 44 could have to register only whether the outcome has occurred during a play of the underlying game.

When the bet stipulates that a unique predetermined player will receive at least one of a number of predetermined events, the dealer 44 could have to register only the event effectively received by the determined player.

When the bet stipulates that at least one of a number of players will receive a unique predetermined event, the dealer 44 could have to register player identifications associated to the players who have received the unique predetermined event during the play of the underlying game.

When the bet stipulates that at least one of a number of players will receive at least one of a number of events, the dealer 44 could have to register a number of combinations of: player identifications and events received by the identified players.

In an alternative embodiment, the underlying game interface 14 could determine automatically each event received or associated to each player during a play of the underlying game. For example, such an alternative embodiment could be a card reader or a digital card system.

Upon reception of the underlying game outcomes, the game controller 22 stores the underlying game outcome data into a game controller outcome data memory 80 in communication with the game controller 22. Typically, the outcome data comprises data such as: underlying game play identification and underlying game play outcomes (i.e. player identification and event associated with the player identified).

Once bet selection data and underlying game outcome data for a same play of an underlying game have been received, the game controller 22 determines the degree of match between the bet selection data stored into the game controller bet selection memory 78 and the underlying outcome data stored into the game controller outcome data memory 80 corresponding to the same play of the underlying game.

A plurality of prize amounts can be determined based on bet selection data stored into the game controller bet selection memory 78, and underlying game outcome data stored into the game controller outcome memory 80. According to the game program selected, a number of data are compared and/or accumulated and/or counted in order to identify a prize upon comparison and/or accumulation of a number of data.

Preferably, the game controller 22 determines the number of winning bet selections made by at least one player participating in one or a plurality of plays of the auxiliary games. For a number of winning bet selections made by a player, a plurality of prize amounts can be determined. For example, a player participating to the auxiliary game of the present invention, has selected a number of players participating in a play of the underlying game, and wagered that the number of players will receive a number of determined events. Upon comparison of bet selection data made by this player and underlying game outcome data for the corresponding play, the game controller 22 identifies the winning bet selections made by the player. If there is only one winning match between a event and a player participating in a play of the underlying game selected by the player, a first prize level is calculated; if there are two winning matches between two events and two players participating in a play of the selected underlying game, a second prize level is calculated, and so on. Another example is that a plurality of prizes could be determined according to the number of match bet selections, winning and/or losing, for a number of plays of one or more underlying games.

The capacity of the system of the present invention to determine a plurality of prizes based on bet selection data stored into the game controller bet selection memory 78 and on underlying game outcome data stored into the game controller outcome memory 80, provides many advantages, such as, enabling to award larger prize in consequence of lower odds of such events, determining players to wager more and enhancing the dedication of players to the game.

According to the corresponding game program stored into a game controller game program memory 82 in communication with the game controller 22, and according to the corresponding payout determining program stored into a game controller payout determining programs memory 82, the game controller 22 determines winning bet selections and calculates prizes to be awarded.

Depending on the game program, prize amounts can be determined as a function of the event, as a function of the number of players playing at the play of the underlying game, as a function of the number of players participating to the auxiliary game, as a function of the jackpot fund. Furthermore, the prize could be a predetermined fixed amount, a randomly selected prize amount from a set of predetermined fixed amounts, a predetermined percentage of the jackpot fund or a randomly selected percentage of the jackpot fund.

Once the winning bets have been determined and the corresponding prize amounts have been calculated, the jackpot fund amount is deducted from the corresponding calculated prize amounts, and the new jackpot fund value is stored into the jackpot fund memory 84 in communication with the game controller 22.

The player credit payout data—i.e. winning bets and corresponding prize amounts—are communicated from the game controller 22 to the underlying game interface 14 and/or to player participation station controller(s) 76 and/or to the table display 18 and/or to wall displays 24.

In a preferred embodiment, the player credit payout data are sent first to the underlying game interface 14. Once the player credit payout data have been received by the underlying game interface 14 and communicated via indicators or displays to the dealer 44, the dealer 44 pays prize amounts to the winning players communicated by the underlying game interface 14. Prize amounts may be given out manually, as chips or tokens and/or electronically, with the help of the underlying game interface 14, credit amounts may be transferred directly into the credit bank value memory 63 associated to the player participation station 10 corresponding to the winning player(s).

In another preferred embodiment, the player credit payout data are sent directly from the game controller 22 to the player participation station 10 and winning credit amounts are added automatically to credit bank value memory 63 of the corresponding player participation station 10 associated with the winning player(s) participating in the auxiliary game played in conjunction with the underlying game.

In another embodiment, the underlying game outcome data and/or player credit data are displayed automatically on table display 18 and/or wall display 24. In another embodiment, the underlying game interface 14 has to send a signal to the table display 18 and/or the wall display 24 for displaying underlying game outcome and/or player credit data on the table display 18 and/or the wall display 24.

As noticed previously, a bet identifies at least one player participating in a play of the underlying game such that at feast one of a number of determined events will be associated to the at least one player.

The at least one identified player by a bet could be determined by the casino house, by a player making the bet or alternatively, may be randomly selected by a random player selector. In a preferred embodiment, a random player selector 28 is in communication with the game controller 22. In a such embodiment, the random player selection data are communicated to players 48 via selected player/gaming symbol indicator(s) 72 and to dealer 44 via the underlying game interface 14. The random player selection data can be also communicated to both players 48 and/or dealer 44 via the table display 18.

Similarly, the at least one of a number of determined events could be determined by the casino house, by a player making the bet or alternatively, may be randomly selected by a random gaming symbol selector. In a preferred embodiment, a random gaming symbol selector 26 is in communication with the game controller 22. In a such embodiment, the random gaming symbol data are communicated to players 48 via selected player/gaming symbol indicator(s) 72 and to dealer 44 via the underlying game interface 14. The random player selection data can be also communicated to both players 48 and/or dealer 44 via the table display 18.

As it will be understood by a skilled person in the field, the random player selector and/or the random gaming symbol selector can take other embodiments such as manual-, electrical- or electro-mechanical devices. Furthermore, such as random selection devices could be independent or in communication with a plurality of units such as, the table display 18, the plurality of player participation stations 10, the underlying game interface 14 a local network 12 or a main network 18. In all cases however, the results of random selections have to be communicated to the game controller 22 in order to manage and resolve the player bet selections according to the underlying game outcomes. The random selection data could be performed directly by a communication link to the game controller 22 or can be entered via a device such as an underlying game interface 14.

An interesting feature arising from the use of random selection devices is that, in some preferred embodiments, the players participating in the auxiliary game can make their betting selections even though the event associated to each player have been revealed for the underlying game. The main point to respect is that at least one part d the combination bet data—i.e. either the player selection data or gaming symbol data—has to be randomly selected after the players participating in auxiliary game have selected their betting options.

Figure 5:
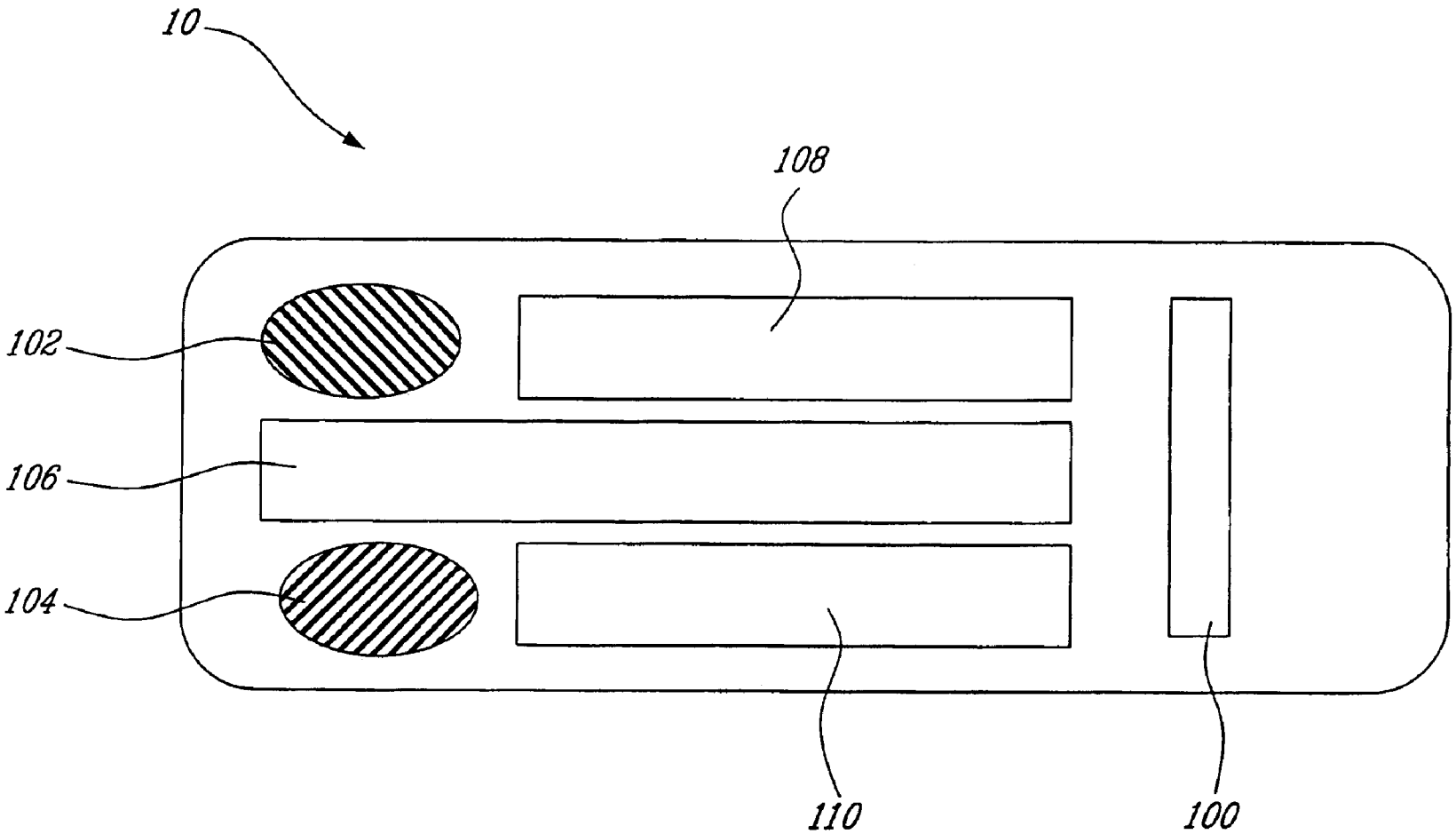
FIG. 5 is a schematic representation of a player participation station according to a preferred embodiment of the present invention.

Now referring to FIG. 3 and FIG. 5, the auxiliary game is played in conjunction with an underlying casino game. Typically, the underlying game 58 is played by a dealer 44 and at least one player 46 and/or 48 located at a player position around an underlying game table 56. During the play of the underlying game, some gaming symbols are received by or associated with at least one of players 46 and/or 48—including the dealer 44.

For example, in card games, each player 48 participating in a play of an underlying game receives a number of playing cards. Each playing card or the number of playing cards received by a player provide a plurality of gaming symbols such as numbers, colors, figures, and suits which can be associated to the player.

There is preferably provided at each player position, a player participation station 10. The player participation station 10 comprises two distinct keys 102 and 104 each associated with a bet credit amount selection display respectively 108 and 110, a credit bank value display 106 and a credit value device reader, in the present embodiment is a chip acceptor-detector 100.

Each distinct key 102 or 104, integrates into a same key device a bet amount selection key 66, a player selection key 68 and a player selected indicator 72. In the present embodiment, each key is associated to a particular player, more particularly, the key 102 is associated to the dealer 44 and the key 104 is associated to the player 46 or player 48 located at the player position associated to the corresponding player participation station 10.

According to the present embodiment, the player 46 and/or player 48 who wants to participate in the auxiliary game inserts chips into the slot of the chip acceptor-detector 100 of his corresponding player participation station 10. The total credit value of the chips 40 inserted into the slot and detected by the chip acceptor-detector 100 are displayed on the credit bank value display 106. According to the present embodiment, activating a first time one of the keys—i.e. keys 102 and/or 104,—the player associated with the key is selected—i.e. respectively the dealer 44 and/or the player 46 and/or player 48 The activated key is lit indicating which player is selected for a bet and a credit amount value is displayed on the corresponding bet credit amount selected display—respectively 108 and/or 104. The credit bank value displayed on the credit bank value display 106 is subtracted from the corresponding bet credit value amount(s) displayed on the corresponding bet credit amount selected display(s)—i.e. 108 and/or 110.

Figure 6:
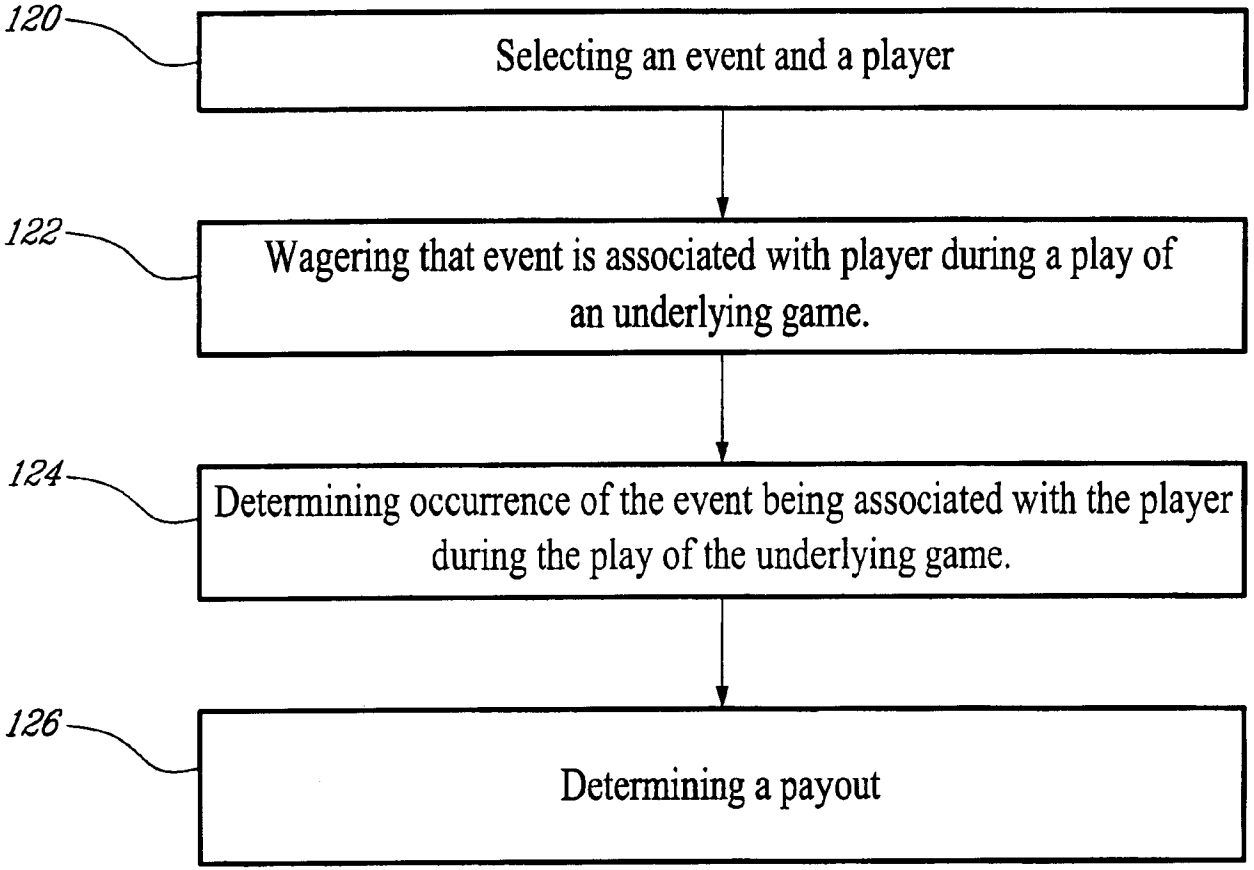
FIG. 6 is a flowchart representing the main steps of a method of the present invention.
Figure 7A:
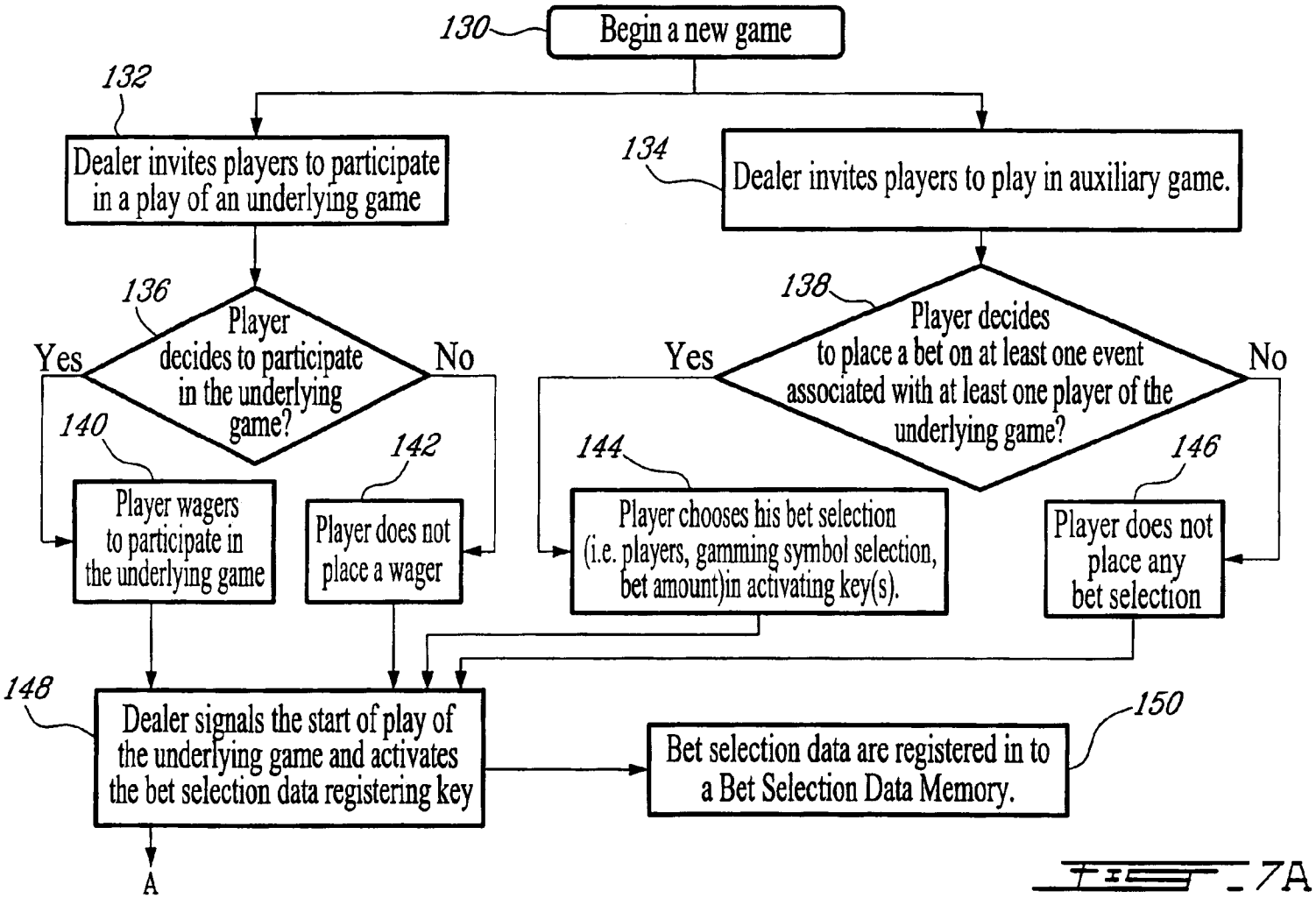
FIGS. 7A, 7B and 7C, when combined, form a flowchart representing detailed steps of a method according to a preferred embodiment of the present invention.
Figure 7B:
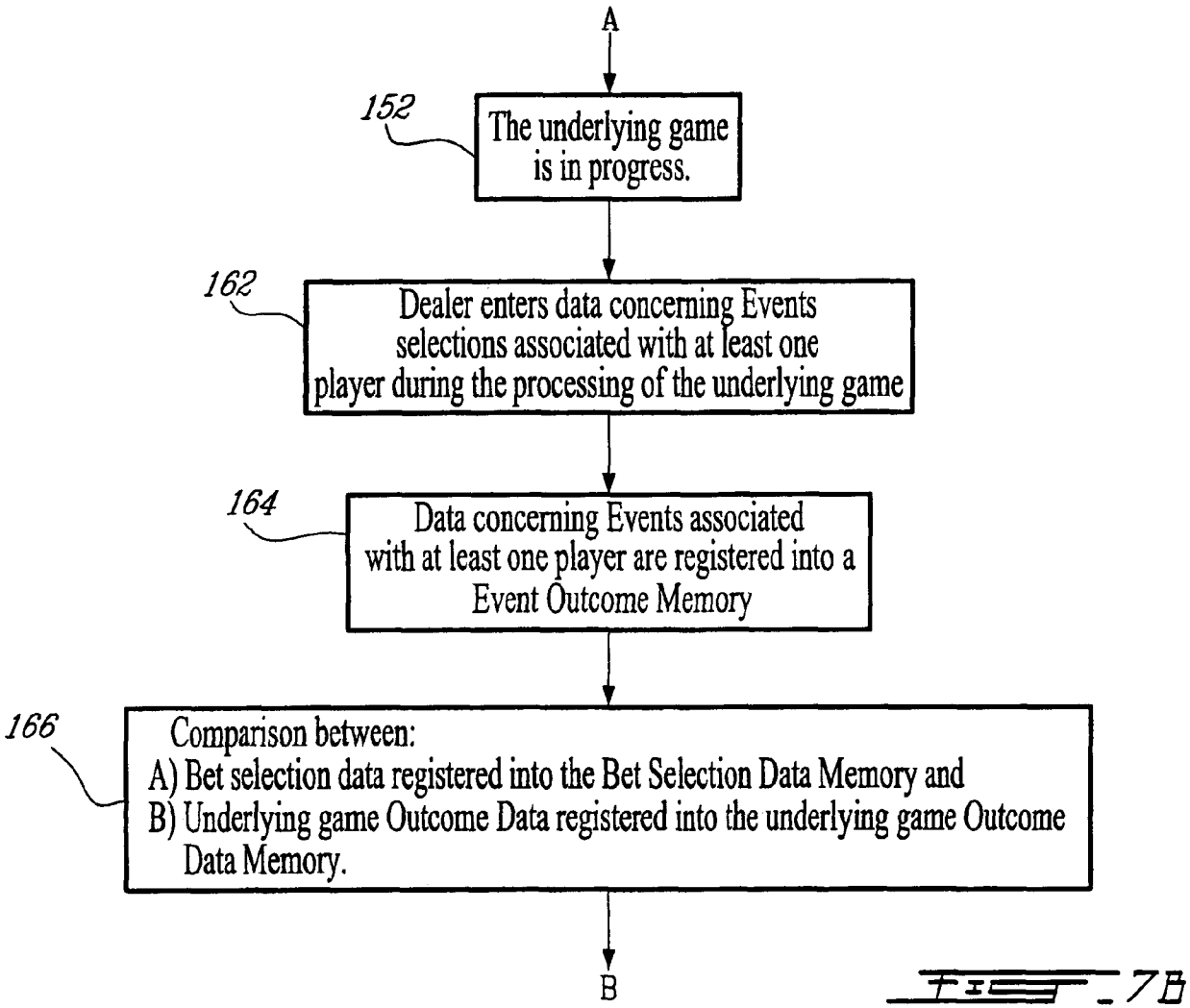
Figure 7C:
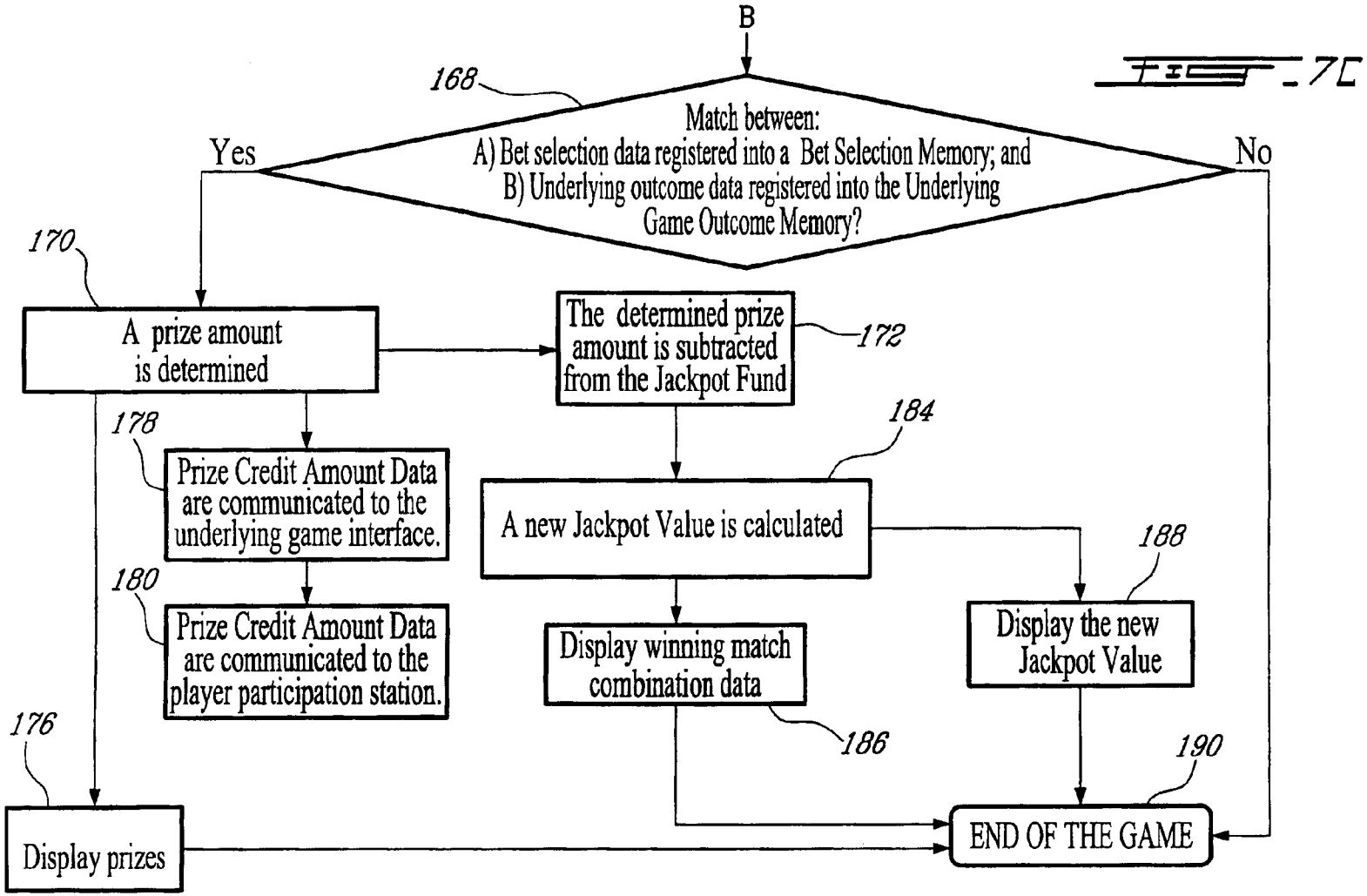

Referring now to FIG. 6, the method of the present invention comprises the step of identifying a selection of at least one of a number of events 120.

According to a preferred embodiment, a new game begins 130 at an underlying game table 56. The dealer 44 invites players 46 and 48 to participate in a play of the underlying game 132. At the same time, the dealer 44 invites players 46 and 48 to bet on that at least one of number of event will be associated with at least one player during the play of the underlying game 134.

The underlying game can be a card game such as poker, blackjack or baccarat. A number of card hands are preferably determined by the casino house as events on which bets can be made.

For example, in poker games (such as, High-Low poker, Texas poker, Hold'em poker or other one to seven card pokers), a number of some high and/or value card hands (such as royal flush, straight flush, four of a kind, full house, flush, straight, three of a kind, two pairs, a pair, ace and king) can be determined to be events that players 46 and 48 can select as bet events that will be associated with a selected player during a play of the underlying game. Any qualifying dealer hand, such as, an Ace-King hand, for a five card poker or a Queen-eight hand, for a three card poker, can be determined to be a event Other types of events can be identified as possible betting events as a high-value, low-value or no-value card hand such as any original combination of cards consisting of determining a number of cards and a plurality of face values and suits associations. For example, subcategories of typical categories of poker hands can be created, such as, Ace-King of any suit, Ace-King of the same suit, Ace-King of a particular suit; Pair of any kind, pair of a specific kind, pair composed of a particular composition of suits and a pair of a specific kind and composition of suits; two pairs of any kind, two pairs of two specific kinds, two pairs of a particular composition of suits and two pairs of two specific kinds and of a particular composition of suits, and so on, for each type of typical hands.

Consequently, a number of these subcategories permit to offer a plurality of prize levels for each type of a typical poker hand selected by a player who wagers that a number of players participating in the underlying game will receive a subcategory poker card hand. Similarly, a player who has wagered that two players, participating in a play of the underlying game, will receive a same type of card hand, creates the possibility of determining a plurality of prizes for a same winning double match. For example, if a player Z has bet that player X and player Y, participating in a play of the underlying game, will receive a flush and indeed, the players X and Y have received a flush, player Z is eligible to win a prize. Since player Z has two winning matches in a same play, player Z could be eligible to also win a bonus prize. In addition, if the flush hands received by the players are composed of a number of same face value cards, a larger bonus prize could be awarded.

In the same manner, for blackjack, different categories of blackjack hands could be considered, such as standard blackjack, blackjack of certain rank value combinations and/or of certain suit combinations. For example, a blackjack of a certain specified rank could be an ace and a ten, both cards being of any suit. Alternatively, a rank blackjack may be any ace and king, if the king is the specified rank, or any ace and queen, if queen is the specified rank; a suited blackjack is an ace and any ten value card, both cards being of the same suit, such as, an ace of clubs and a jack of clubs or an ace of hearts and a queen of hearts. Other types of events can be identified as possible betting events, such as new and original combinations of cards consisting of a card hand which is an association of a number of cards, a number of face values and a number of suits associations.

Preferably, a number of events determined by the casino house are displayed on a advertising panel 42. Of course, the displaying means can take a plurality of embodiments, such as, a material panel, an electrical display or a video monitor.

Preferably, the player decides independently to participate in a play of the underlying game 136. If the player 46 and/or player 48 decides to participate in a play of the underlying game, the player makes a wager as prescribed by the underlying game rules 140. Of course, a player 46 and/or player 48 who decides not to participate in the underlying game, simply does not place a wager.

In referring to FIG. 6, the present invention discloses a method comprising the step of wagering that at least one of the number of events is associated with at least one player, during at least one play of the underlying game 122.

Alternatively and independently, a player may choose to participate in the auxiliary game by placing a bet such that at least one number of events will be associated with at least one player of underlying game 138.

Players 46 and/or 48 have the option to bet that the dealer 44 and/or themselves as players participating in a play of the underlying game, will receive at least one of the determined events identified on the panel 42.

If a player 46 and/or player 48 decides to participate in a play of an auxiliary game, the player chooses his/her bet selection—i.e. players) and bet credit amount—by activating appropriate key(s) 144.

In order to be able to place a bet, a player has to have enough credit available in his/her credit bank. A player 46 and/or player 48 who wants to participate, inserts a number chips in the chip acceptor-detector 100 of his/her corresponding player participation station 10. The credit value of the number of chips inserted into the chip acceptor-detector 100 is displayed on the credit bank value display 106.

A player 46 who decides to make a bet selection has to activate one or both of the keys 102 and/or 104 of the player participation station 10.

The key 102 is associated to the dealer 44 and the key 104 is associated with a player 46 and/or player 48, who makes the bet. Of course, a player who decides to participate in the auxiliary game by making a bet on his/her chance of receiving a determined event during the play of the underlying game, has to participate in the corresponding play of the underlying game. Alternatively, a player who decides to participate only in the auxiliary game can do so, by making a bet selecting only the dealer 44 or only on another player.

A player presses one of the two keys in order to make a bet selection associated with one of the two players—i.e. himself or herself (46 and/or 48) and/or the dealer 44. The first time that a key is pressed, a predetermined credit amount is selected as the bet amount wagered on the occurrence that the selected player associated to the key pressed will receive at least one of the events displayed on the panel 42. The key pressed is activated and lit, indicating the player selected. The credit amount selected is displayed on the corresponding bet credit amount selection display 108 and/or 110 and the same credit amount is subtracted from the credit bank value display 106. Furthermore, if a player decides to bet a larger credit amount, the player presses the corresponding key(s) until the desired bet credit amount is displayed on the corresponding bet selected credit amount display 108 and/or 110. Consequently, the total credit amount(s) displayed on the bet credit amount selection display(s) 102 and/or 104 is deducted from the credit bank value displayed on the credit bank value display 106.

A player who decides not to participate, does not make any bet selections 146. In the present embodiment, this means that no keys are pressed or activated.

The dealer 44 signals the start of a play of the underlying game and activates the bet selection data registering key 148 of the underlying game interface 14. At this point, the activated bet data registering key generates a signal, which is sent via the underlying game interface 14, signaling to the player participation stations 10 associated to the same underlying game, to send to the game controller 22, the bet selection data stored into the player bet selection data memory 74 associated with each player participation station 10.

Alternatively, the signal generated by the activated key of the underlying game interface 14 can be sent to the game controller 22. Upon receipt of the signal, the game controller 22 sends a signal to each player participation station 10 associated to the underlying game interface 14, in order to collect the player bet selection data stored in each player bet selection data memory 74, in communication with each player participation station 10.

Upon receipt of the player bet selection data, the game controller 22 stores in a game controller bet selection data memory 78 the corresponding player bet selection data 150. Namely, each memory cell (a part of the memory that contains data concerning a single bet) associated to a particular bet of the game controller bet selection data memory 78 comprises typically: the bet credit amount, the event, the player selection, the corresponding player station identification and identification of the play of the underlying game.

The underlying game is in progress 152.

Referring back to FIG. 6, the method comprises the step of revealing at least one of the events associated with at least one player during at least a play of the underlying game 124.

The underlying game 56 can be one of a plurality of card games such as poker, blackjack or baccarat. In the case of poker, the gaming symbols to be considered for playing the auxiliary games could be the cards dealt to each player at the beginning of a new play or the resulting final hand that each player decides to keep.

Similarly, for blackjack games, the cards to be considered could be only the first two cards dealt to each player or all the cards dealt to a player during a play of the game.

In a preferred embodiment, the blackjack game is the underlying game. The gaming selections determined by the house as winning combinations in the auxiliary games are high card hands such as: royal flush, straight flush, four of a kind, full house, flush, straight, three of a kind, two pairs and one pair.

In a preferred embodiment, these events are identified and displayed on the table display 18 and/or indicated onto the panel 42.

The dealer 44 deals cards 50 to the players. The dealer 44 may enter data corresponding to a determined event received by a particular player as the play is progressing, or alternatively, the dealer 44 could wait until the end of the play for registering data concerning the receipt of one of the determined winning event by a player participating in a play of the underlying game.

During the play or at the end of the play of the underlying game 58, the dealer 44 with the help of the underlying game interface 14, enters the underlying game outcome data 162, such as the event associated with at least one player during the course of the underlying game 162.

For example, if a dealer 44 receives a three of a kind and a player receives a royal flush, then, the dealer 44 with the underlying game interface 14 enters the combination of the dealer 44 having received a three of a kind card hand, and enters the identification data associated to the player who has received the royal flush as a card hand. Identification data is associated to each player participation station 10. Such player identification data could be a number, a letter, a color, or any other symbol, as well as any of the various possible combinations.

The underlying outcome data entered onto the underlying game interface 14 are sent to the game controller 22. Upon receipt of the underlying outcome data, the game controller 22 stores the outcome data 164, corresponding to a play of the underlying game into a game controller outcome data memory 78.

Referring back to FIG. 6, the method comprises the step of determining a payout if there is a match between the bet selection data and the underlying game data 126.

Once data concerning event associated with at least one player are registered into the underlying game outcome memory 164, the game controller 22 makes a comparison between the bet selection data registered into the bet selection data memory 78 and the underlying game outcome memory 80 for the same play of the underlying game.

If there is a match between any of the bet selection data registered in the bet selection memory and the underlying game outcome data registered into the underlying game outcome memory 168, a prize credit amount is determined 170 according to a payout chart program and with the auxiliary game rules.

For example, if the dealer 44 is the selected player, then if the dealer received a high value hand such as a royal flush, a straight flush, a four of a kind, a full house, a flush, a straight, three of a kind, two pairs, the player has a winning bet since the dealer has received one of selected event.

Similarly, in the same play, if a player 46 and/or 48 has bet that he or she will receive a high value card hand, such as a royal flush, as defined among the high value hands identified as events, and the player has effectively received a high value hand identified as a event, the player wins.

The payout could be established as a function of the bet amount, as a function of the event, as a function of the number of players, and as a function of the jackpot. Furthermore, the prize could be a predetermined fixed percentage of a progressive jackpot amount, a random percentage of a progressive jackpot amount, a random percentage of a fixed jackpot amount, a randomly selected amount from a set of predetermined fixed amounts.

Once the prize credit amount is determined 170, the jackpot fund is subtracted from the prize amount determined 172. If there is no match between the bet selection data registered into the bet selection data memory 78 and the underlying game outcome data registered in the underlying game outcome memory 80 no prize credit amount is determined and no prize credit amount is subtracted from the jackpot fund.

The game controller 22 communicates the prize credit amount data—comprising: identification of the player participation station 10 associated to the winning player and the prize credit amount awarded to the underlying gaming interface 178.

The player credit payout data can be displayed on a plurality of types of displays such as an LCD display, seven-segment-led displays, a video monitor, etc.

The dealer 44 reads the prize credit amount data communicated by the underlying game interface 14. The prize credit amount data includes identification data of the player participation station 10 associated to the winning player and the prize credit amount awarded to the winning player.

The dealer 44 gives the winning player a number of chips 40 or other tangible devices, such as tokens, tickets, etc., corresponding to the prize credit amount won. In another preferred embodiment, the dealer 44 reads the information communicated through the underlying interface 14—i.e. winning player identification and prize credit amount—and with the help of his or her underlying interface 14 transfers electronically the prize credit amount to the credit bank value memory in communication with the player participation station 10, associated to the winning player identified and communicated by the underlying game interface 14.

in another preferred embodiment, the prize credit amount data is communicated directly to each player participation station 10 associated with a winning player 180. According to a plurality of embodiments, the prize credit amounts can be either added automatically to the player credit bank memory 63, delivered manually, as chips 40 or electronically through the underlying game interface.

The prize credit amounts awarded 176, the winning match combination data 186 and the new jackpot value 188 are displayed on a table display 18 and on a wall display 24.

When all the wins and losses of the underlying game and the auxiliary have been resolved, the game ends 190.

It will be understood that the event on which the player bets in the auxiliary game could be the losing or winning status of a player of the underlying game at the end of at least one play of the underlying game. For example, a player could bet, in the auxiliary game, that another player will lose. This would be a preferred embodiment of the present invention in the case where the casino game being played is the Roulette.

In a preferred embodiment, securing and/or consolation auxiliary prizes are offered to players who participate in both the auxiliary game and the underlying game. For example, a player decides to participate in both the underlying game and the auxiliary game. In the auxiliary game, he chooses to bet on himself and/or the dealer and/or another player. If he loses or there is a push in the underlying game, he can still win an auxiliary prize amount. This extra payout schedule constitutes an incentive for players to participate in both the underlying and auxiliary games. It constitutes a securing or a consolation prize.

An example of such a situation would be as follows: a player places a bet in the underlying game which is, for example, Poker. The player decides to place a bet in the auxiliary game on the dealer. In the underlying game, the hand he finishes with is, for example, a three of a kind. The dealer finishes with a four of a kind. The player therefore loses to the dealer in the underlying game. Because the player had a three of a kind which is a better hand than a two of a kind and because he also bet anything on the auxiliary game, he is eligible to the special push-lose consolation prizes. The player could then be awarded a fixed amount prize or a prize calculated from a percentage of a jackpot. Using the data of Table 1 the player would receive a prize of $75.00. In addition to this, the player could still have won in the auxiliary game. He would then receive an additional prize for having won in the auxiliary game.

A further example of such a situation would be as follows: a player places a bet in the underlying game which is, for example, Poker. The player decides to place a bet in the auxiliary game on both himself and the dealer. In the underlying game, the hand he finishes with is, for example, a push with 2 pairs or better to the Dealer's underlying game hand outcome. For example, both the player and the dealer ended the play with a four of a kind hand. In this situation a second, more special and larger auxiliary prize is attributed since the player placed two auxiliary bets in the auxiliary game. The prize amount is then determined according to the type of the push card hand received by the player in the play of the underlying game and by the number of bets the player has placed in the auxiliary game.

For illustration purposes, the push-losing hand pay-out table for securing and/or consolation auxiliary prizes depending on the losing or push hand at the end of the underlying game for which a player has made an auxiliary bet on any player could be as follows for an underlying game of Poker:

TABLE 1

Push-Losing Hand Preferred Payouts for Poker with one auxiliary bet

| Push or Losing Hand of the Player in the Underlying Game | Prize Amount when one bet placed by the player in auxiliary game |
|---|---|
| 4 of a Kind or better | $10,000.00 |
| Full House | $5,000.00 |
| Flush | $2,000.00 |
| Straight | $500.00 |
| 3 of a Kind | $75.00 |
| 2 Pairs | $25.00 |

Preferably, the hand outcome pay-outs are paid in the following order: player hand pay-out, push and losing hand payout, auxiliary game payout and then Dealer hand payout.

A number of auxiliary events can be established in association with a push and/or losing status of the hand or the combination of gaming symbols with which a player finishes in the underlying game. Such securing and/or consolation auxiliary prizes can be implemented in a plurality of types of casino games, and particularly well into a plurality of casino card games.

Furthermore, offering players a number of auxiliary prizes as securing and/or consolation prizes which depend on the underlying game, when the auxiliary prize amounts are higher as a function of the number of auxiliary bets constitutes a real incentive for players to bet a plurality of auxiliary bets, and constitutes, for casino houses, an opportunity of maximize the total bet amount for an underlying game.

It will be understood that numerous modifications thereto will appear to those skilled in the art. Accordingly, the above description and accompanying drawings should be taken as illustrative of the invention and not in a limiting sense. It will further be understood that it is intended to cover any variations, uses, or adaptations of the invention following, in general, the principles of the invention and including such departures from the present disclosure as come within known or customary practice within the art to which the invention pertains and as may be applied to the essential features herein before set forth, and as follows in the scope of the appended claims.

What is claimed is:

1. A method of playing an auxiliary casino game managed by a casino house the method comprising:

associating at least one event with at least one participating player participating in an underlying casino game during a play of said underlying casino game;

a betting player selecting at least one of said participating player on which to place a bet;

said betting player identifying at least one event related to at least one play of said underlying game for which to place said bet, wherein said event is meaningful within said underlying game;

said betting player making at least one bet that said at least one event will occur in association with said at least one participating player during at least one play of said underlying game;

determining an occurrence of said at least one event in said underlying game in association with said at least one participating player; and if said at least one event occurred in association with said at least one participating player, determining an auxiliary payout to be paid to said betting player for said auxiliary game;

wherein said betting player is one of said participating player and a player with whom an event is not associated in the underlying casino game.

2. The method as claimed in claim 1, wherein said at least one event is receiving at least one predetermined gaming symbol.

3. The method as claimed in claim 1, wherein said at least one event is receiving at least one randomly selected gaming symbol.

4. The method as claimed in claim 1, further comprising said betting player making a bet in said underlying game;

said betting player playing said underlying game;

if an outcome of said playing is at least one of a tie or a loss in said underlying game, determining a consolation payout to be paid to said betting player.

5. The method as claimed in claim 1, wherein said at least one event is selecting at least one participating player playing in said underlying game.

6. The method as claimed in claim 1, wherein said at least one event is a status of said at least one participating player at the end of at least one play of the underlying game, wherein said status is one of a winning and a losing status.

7. The method as claimed in claim 1, wherein said participating player is said betting player.

8. The method as claimed in claim 1, wherein said participating player is a dealer of said underlying game.

9. The method as claimed in claim 1, wherein the underlying game is a card game.

10. The method as claimed in claim 1, wherein said at least one participating player is randomly selected.

11. The method as claimed in claim 1, wherein said at least one play is three plays.

12. The method as claimed in claim 1, wherein a dealer of said underlying game determines said occurrence.

13. A system for playing an auxiliary casino game, the system comprising:

an event determiner for associating at least one event least one participating player participating in an underlying casino game during a play of said underlying casino game;

a player selection receiver for receiving a player selection from at least one betting player, said player selection identifying at least one of said participating player on which to place a bet;

an event receiver for receiving from said at least one betting player, an identification of at least one event related to at least one play of said underlying game for which to place said bet, wherein said event is meaningful within said underlying game;

a bet receiver for receiving a bet from said at least one betting player that said at least one event will occur in association with said at least one participating player during at least one play of said underlying game;

auxiliary bet display means for displaying an identification of said at least one selected participating player of said underlying game and of said at least one identified event related to said participating player of said underlying game;

an outcome receiver for receiving an outcome indication indicating if said at least one identified event in said underlying game occurred in association with said at least one selected participating player of said underlying game during said at least one play of said underlying game;

a winning player determiner for determining which of said betting players placed a bet on the outcome which occurred;

wherein said betting player is one of said participating player and a player with whom an event is not associated in the underlying casino game.

14. The system as claimed in claim 13, wherein said betting player of said auxiliary casino game is said participating player of said underlying game.

15. The system as claimed in claim 13, wherein said participating player of said underlying game is a dealer of said underlying game.

16. The system as claimed in claim 13, further comprising a random player selector for randomly selecting at least one participating player of said underlying game and providing said selection to said player selection receiver.

17. The system as claimed in claim 13, further comprising a random event selector for randomly selecting said at least one event identification and providing said selection to said event receiver.

18. The system as claimed in claim 13, further comprising wagering means for receiving a bet credit amount corresponding to the bet credit amount wagered on said bet.

19. The system as claimed in claim 13, further comprising a payout determiner for determining a payout to be paid to said at least one winning betting player of said auxiliary casino game using said bet received and said event indication.

20. The system as claimed in claim 19, wherein said payout determiner calculates said payout as a function of at least one of an importance of the event in the underlying game, an importance of the event in the auxiliary game, a number of occurrences, a number of participating players playing in the underlying game, a number of betting players participating in the auxiliary game and a jackpot fund value.

21. The system as claimed in claim 19, wherein said payout is at least one of a predetermined fixed amount, a prize amount randomly selected from a set of predetermined fixed amounts, a predetermined percentage of a jackpot fund value, end a randomly selected percentage of jackpot fund value.

* * * * *